United States Patent [19]

Fagan et al.

[11] 4,452,440

[45] Jun. 5, 1984

[54] PAPER FEEDING APPARATUS AND CART

[75] Inventors: Edmund I. Fagan, Bellevue; Richard P. Guthrie; Robert G. Railton, both of Kirkland, all of Wash.

[73] Assignee: EMF Corporation, Redmond, Wash.

[21] Appl. No.: 297,424

[22] Filed: Aug. 28, 1981

[51] Int. Cl.[3] ..... B65H 5/22

[52] U.S. Cl. ..... 271/3.1; 271/5; 271/155; 271/158

[58] Field of Search ..... 271/3.1, 5, 11, 259, 271/155, 157, 158, 147

[56] References Cited

U.S. PATENT DOCUMENTS

| | | | |
|---|---|---|---|
| 1,872,402 | 8/1932 | Candee . | |
| 2,823,788 | 2/1958 | Chase . | |
| 2,900,186 | 8/1959 | Schwebel | 271/158 |
| 2,956,802 | 10/1960 | Huck . | |
| 3,072,052 | 1/1963 | Bach . | |
| 3,126,199 | 3/1964 | Rosoff . | |
| 3,240,089 | 3/1966 | Chamberlain . | |
| 3,240,488 | 3/1966 | Lyman . | |
| 3,240,489 | 3/1966 | Pinckney . | |
| 3,262,699 | 7/1966 | Aschenbrenner . | |
| 3,298,682 | 1/1967 | Gatti . | |
| 3,404,790 | 10/1968 | Brookhyser | 271/157 X |
| 3,438,707 | 4/1969 | Hanson . | |
| 3,640,523 | 2/1972 | Beck . | |
| 3,661,383 | 5/1972 | Morrison . | |
| 3,797,196 | 3/1974 | Harbison . | |
| 3,975,013 | 8/1976 | Deisting | 271/275 |
| 4,014,539 | 3/1977 | Goodwin | 271/184 |
| 4,018,434 | 4/1977 | Mitchell | 271/96 |
| 4,019,435 | 4/1977 | Davis | 101/232 |
| 4,173,410 | 11/1979 | Tabata | 355/24 |
| 4,186,662 | 2/1980 | Borneman | 101/218 |

FOREIGN PATENT DOCUMENTS 554138 6/1943 United Kingdom .

*Primary Examiner*—Richard A. Schacher
*Attorney, Agent, or Firm*—David L. Garrison

[57] ABSTRACT

Paper handling equipment is disclosed having a cart and a paper feeder. The paper feeder has an elevator and a paper feed train. The cart allows rolling transfer of a stack of paper sheets from the cart to the elevator in the paper feeder. The elevator positions the stack of paper sheets with respect to a desired elevation of the top sheet in the stack. The paper feed train removes the top sheet from the stack of paper in the elevator by using a rotating high-vacuum wheel. Included is a marker sheet detection means for detecting specially prepared marker sheets. A doubles detector is used to eliminate double sheets which are inadvertently fed into the paper feed train. A counting means is used to count the number of single sheets fed. A control means is used to automatically feed a preprogrammed number of sheets from a number of different types of paper separated by marker sheets. Excess copies of paper sheets of any particular type are rejected into a rejection tray. Vacuum transport conveyor belts are used to feed the paper sheets to other paper handling equipment.

7 Claims, 4 Drawing Figures

PAPER FEEDING APPARATUS AND CART

DESCRIPTION

1. Technical Field

This invention relates to paper handling equipment generally and, more specifically, to equipment which can remove individual sheets of paper from a stack and convey them to other paper handling equipment. The invention also relates to programmable control systems for such a paper handling device and a paper stack supply cart for supplying paper to the paper handling device.

2. Background Art

Devices for removing sheets of paper from a stack are well known in the art of paper handling. Some of these devices feed from the top of the paper stack, such as the device shown by Tabata et al in U.S. Pat. No. 4,173,410. Other feed from the bottom of the stack, such as the device shown by Snellman in U.S. Pat. No. 3,385,593.

Most prior art sheet feeders are incorporated in printers, sorters and other paper handling equipment thereby making them difficult to incorporate into or use with a different piece of equipment.

The Snellman device shown in U.S. Pat. No. 3,385,593 and other independent sheet feeders must be adjusted for each kind and size of paper being fed.

Many of the prior art sheet feeders use sheet engagers or graspers, some having suction cup ends for adhering the paper thereto. These graspers are moved mechanically be a system of cam, levers, links, etc., so that the attached sheet is fed into a set of rollers or other means for further movement through the equipment.

DISCLOSURE OF INVENTION

It is an object of this invention to provide a means for feeding sheets of paper from a stack into another paper handling device one at a time at a high rate of speed. It is an object of the invention to provide a means for elevating a stack of paper sheets so that the top sheet remains at an essentially fixed elevation with respect to an associated paper feed train. It is another object of the invention that sheets of paper passing through the paper feeder be counted so that such information can be used in the control of the paper feeder and other paper handling equipment. It is a further object of the invention to incorporate a marker sheet detection system whereby different types of paper can be identified so appropriate operational changes can be made by the control means. A further object of the invention is that a rejection means be provided whereby excess copies of a particular type of paper sheets may be rejected before they are conveyed to another paper handling device, such rejection system also being used to eliminate double sheets of paper inadvertently fed into the feeder system. It is also the object of the invention to provide a means for transferring a stack of paper sheets from an easily accessible and remotely loadable cart to the paper feeder by merely rolling the tray supporting the stack from the cart to the paper feeder.

The invention is a system for feeding paper sheets from a stack of paper. The paper feeder system was developed for use with paper sorters, but its features are general and it can be used with a variety of paper handling equipment.

The paper feeder system has two units. The first unit is a cart and the second unit is the paper feeder. The cart has a removable tray upon which paper sheets are stacked. The cart is located near the paper feeder so the tray and paper stack can be rolled directly into the paper feeder.

The paper feeder has two principal parts. The first principal part is the elevator and the second principal part is the paper feed train. The elevator supports and lifts a tray holding a stack of paper. The top sheet of the stack is constantly maintained at an appropriate elevation so that the paper feed train can remove and further transport the sheets of paper along the paper path to a paper sorter or other related piece of paper handling equipment.

Considering the invention now in more detail, we start with the paper stack elevator which has a removable tray upon which the paper sheets are stacked. The tray is supported within the elevator in a horizontal position by a group of movable chains, belts, cables or similar devices having pins or teeth which engage the tray. The supporting chains, belts or cables are arranged so that the supporting run of each is essentially vertical so that the tray can be moved vertically upward. The supporting chains, belts or cables are arranged around sprockets or pulleys mounted on common shafts or otherwise interconnected so that each supporting run moves the tray an equal amount thereby keeping it in a horizontal position.

The pairs of supporting runs of chains, belts or cables are closer together in the back of the elevator than in the front. This difference in gage requires that the supported tray also be narrower in the back than in the front. The tray is provided with step changes along the sides so that only the supporting runs engage the tray with their pins or teeth.

The supporting chains, belts or cables are driven by an elevator motor means through an elevator motor speed reducer means. The elevator motor speed reducer provides mechanical advantage or gear reduction so that the tray can be raised at a slow speed with a relatively less powerful motor. The reduction in speed helps to equalize the speed of the supporting chains with the desired feed rate of the tray, thereby reducing cyclical switching of the motor through the stack height control switch. The elevator motor means and motor speed reducer means are mounted on the paper feeder frame although alternative mounting arrangements are possible.

The elevator motor is equipped with a motor brake. This brake stops the elevator quickly when the paper stack reaches the feed elevation and prevents movement of the elevator drive system when the motor means is not activated. Alternative braking systems are possible, including brakes attached to other shafts, supporting sprockets or pulleys of the elevator drive system.

The output shaft of the elevator motor speed reducer has a drive sprocket or pulley attached thereto for driving the system of supporting chains, belts or cables. The elevator drive system is interconnected so that the supporting runs of the chains, belts or cables are simultaneously moved an equal distance so that a tray supported thereon rises or descends in a horizontal altitude.

A stack height control system is used to keep the top sheet in the stack within a proper feed elevation zone relative to the paper feed train. A stack height detector is used to determine when the top sheet of the stack is within the feed zone. The stack height detector activates the elevator drive motor when the elevation of the top sheet in the paper stack is below a predetermined low set point. When the stack has been raised to a predetermined high set point the motor is deactivated. The stack height limit switch acts as a safety to deactivate the elevator motor means if the control switch malfunctions. Other means for detecting the elevation of the top sheet are available and can be used with this paper feed so that the elevator automatically controls the elevation of the top sheet after the paper feeder is placed in operation.

The second principal part of the paper feeder is the paper feed train. The paper feed train takes the top sheet of paper from the stack positioned within the elevator and delivers it to another paper handling device. The top sheet of paper is first acted upon by a sheet separator. The sheet separator comprises means for impinging an air jet on one edge of the uppermost sheet in the paper stack. When this jet of air strikes the top sheet it is lifted off the stack into a position closer to the high-vacuum feed wheel which uses a suction effect to adhere this top sheet to the periphery of the wheel. The sheet separator also acts to provide an ample supply of air beneath the top sheet thereby preventing the vacuum from lifting more than one sheet. The air supply to the sheet separator is provided from the exhaust side of a vacuum pump driven by a vacuum pump motor.

The high-vacuum feed wheel grips the top sheet and as the wheel is rotated, feeds the top sheet towards a top guide plate. The top guide plate has stripper portions positioned adjacent to each side of the high-vacuum sheet so that it acts to remove the sheet of paper from the high-vacuum wheel. The high-vacuum wheel feeds the sheet of paper along the top guide plate until the leading edge of the sheet engages a first roller means or a set of first pinch rollers. The upper and lower first pinch rollers roll the sheet of paper along the top guide plate until the leading edge of the sheet engages a first roller means or a set of first pinch rollers. The upper and lower first pinch rollers roll the sheet of paper between them driving the sheet onward along the paper path.

A marker sheet detection means is positioned adjacent to the paper path for identifying marker sheets which pass thereby. Various types of detection means are known in the art and are suitable for use in this paper feeder. The marker sheets are placed between the different types of paper contained in the stack. When the marker sheet detection means identifies the presence of a marker sheet it signals the paper feeder control means and related paper handling equipment so that appropriate operational changes can be made for the new type of sheets.

A double sheet detector is also positioned adjacent to the paper path for detecting the simultaneous feeding of multiple sheets. There are a variety of double sheet detectors known in the art and readily available for use with this paper feeder. These double detectors provide a signal to the rejection diverter actuator so that the multiple sheets are removed from the paper path.

A counting means is provided for counting the number of sheets which pass through the paper feeder. This counting means can advantageously comprise a counting light and a counting light detector which receives intermittant flashes of light. Such flashes are transformed into a numerical count of the number of sheets of a particular type which have passed the counting means. Other counting means are available and can also be used in this paper feeder.

The paper feeder is also provided with a rejection diverter for diverting sheets from the paper path into a rejection tray. This rejection diverter is pivoted into the paper path by a rejection diverter actuator which is preferably a solenoid. This actuator is activated by the doubles detector, the marker sheet detector, or the paper feeder control means to remove all multiple sheets, marker sheets and excess sheets which were included in the stack.

The paper sheets are conveyed past the above devices and through the paper feeder by a group of rollers, guide plates, diverters and vacuum transport conveyors. These components define the paper path and are operated in a coordinated manner so that the sheets are not torn or mutilated. Particular features of these components and their interrelationships are discussed below in the description of the best mode of the paper feeder.

A control means is provided to operate the paper feeder components in an integrated manner and to interface the paper feeder with the other paper handling equipment to which the sheets are being fed. The control means can be preprogrammed so that specific number of different types of sheets can be fed. The order in which these different types are fed is determined by the order of the stack placed in the elevator. It is not necessary that the exact number of sheets be placed in the stack because the control means will allow only the preprogrammed number to be delivered. Any excess in the stack for a given type is diverted into the rejection tray. If the stack does not have enough sheets to meet the preprogrammed demand the paper feeder shuts down until the shortage of sheets is corrected and the feeder is reset by an operator. The control means also compensates for any multiple sheets which may have been rejected so that the exact preprogrammed number of individual sheets are fed.

The paper feeder is advantageously used with a cart for easily transferring a stack of paper to the elevator. The cart frame is supported with casters which allow for rolling movement about the floor. The cart superstructure extends upward to handles giving a convenient and easy means for manually guiding the pushing the cart. Rollers are mounted on both sides of the cart frame for supporting the paper stack tray. The tray can be rolled from the cart directly into the elevator because the cart and elevator rollers are at the same elevation. A tray latch means is provided to prevent inadvertant movement of the tray relative the cart. The cart is also provided with an attachment means for attaching the cart to the paper feeder frame thereby preventing motion between the cart and elevator.

The paper feeder system is used by first stacking the desired sheets upon a tray which is located on the cart and secured thereto with the tray latch means. The specific number of sheets supplied need not be counted but there must be at least the preprogrammed number for each type if ininterrupted operation is expected. Marker sheets are placed between each sheet type to designate the change in types to the paper feeder.

The cart is manually positioned adjacent the paper feeder elevator and attached thereto with the cart attachment means. The tray latch means is then released and the tray is rolled into position inside the elevator.

The control means is then programmed with the number of sheets of each type which are to be fed. The paper feeder is then started. The elevator raises the stack to the feed elevation and feeding begins and continues automatically until completed or until there is an insufficient number of sheets of a particular type to meet the preprogrammed order. The marker sheets serve to reset the counting and control means for each of the different types of sheets. Excess sheets of any type are rejected into the rejection tray as are multiple sheets and marker sheets. After all sheets are properly fed the paper feeder switches into a standby mode to await further work.

BEST MODE OF CARRYING OUT THE INVENTION

Figure 1:
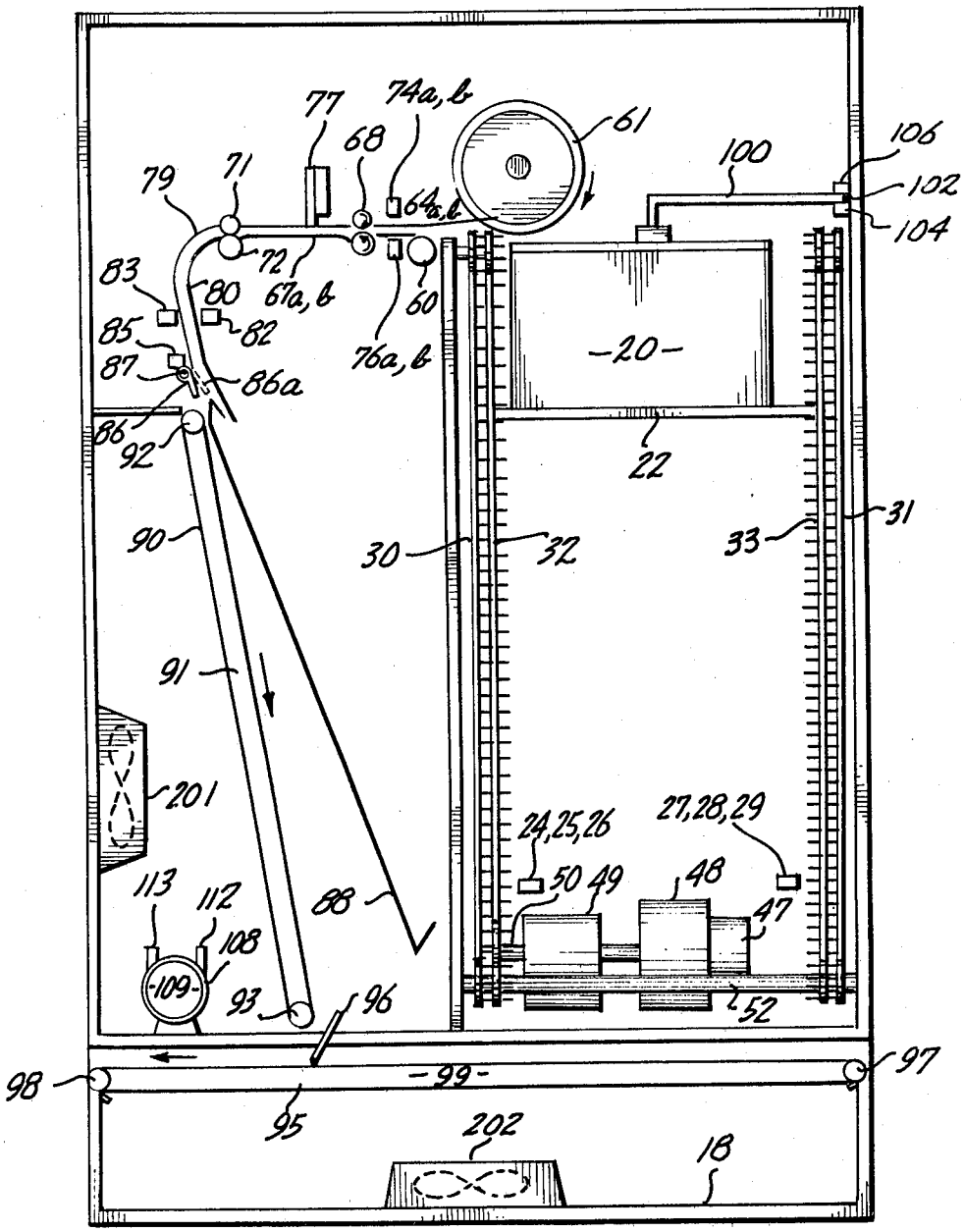
FIG. 1 is a side elevational view of the paper feeder with parts removed for clarity of presentation.

Referring now to the drawings, wherein like numerals indicate like parts, in FIG. 1 a stack of paper sheets 20 is supported upon a tray 22. Tray 22 is supported by first elevator chain 30, second elevator chain 31, third elevator chain 32 and fourth elevator chain 33. See FIG. 2. These elevator chains the elevator chain pins 34 extending therefrom in order to engage the lower surface of the tray 22. The tray 22 can be rolled into the elevator on top of elevator tray rollers 24, 25, 26, 27, 28 and 29. Tray 22 can also be slid into position between the elevator chains at any elevation to rest on elevator chain pins 34.

The first elevator chain 30 and second elevator chain 31 comprise a first pair of tray supporting means near the front of the paper feeder. First elevator chain 30 and second elevator chain 31 are separated by a distance equal to a first gage. Third elevator chain 32 and fourth elevator chain 33 comprise a second pair of tray supporting means near the rear of the paper feeder having a second gage which is smaller than the first. To accommodate these different gages tray 22 is provided with steps 171, 172 and 173. Steps 171 and 172 are located so that only the front runs of first and second elevator chains 30 and 31 engage tray 22 with chain pins 34.

Figure 2:
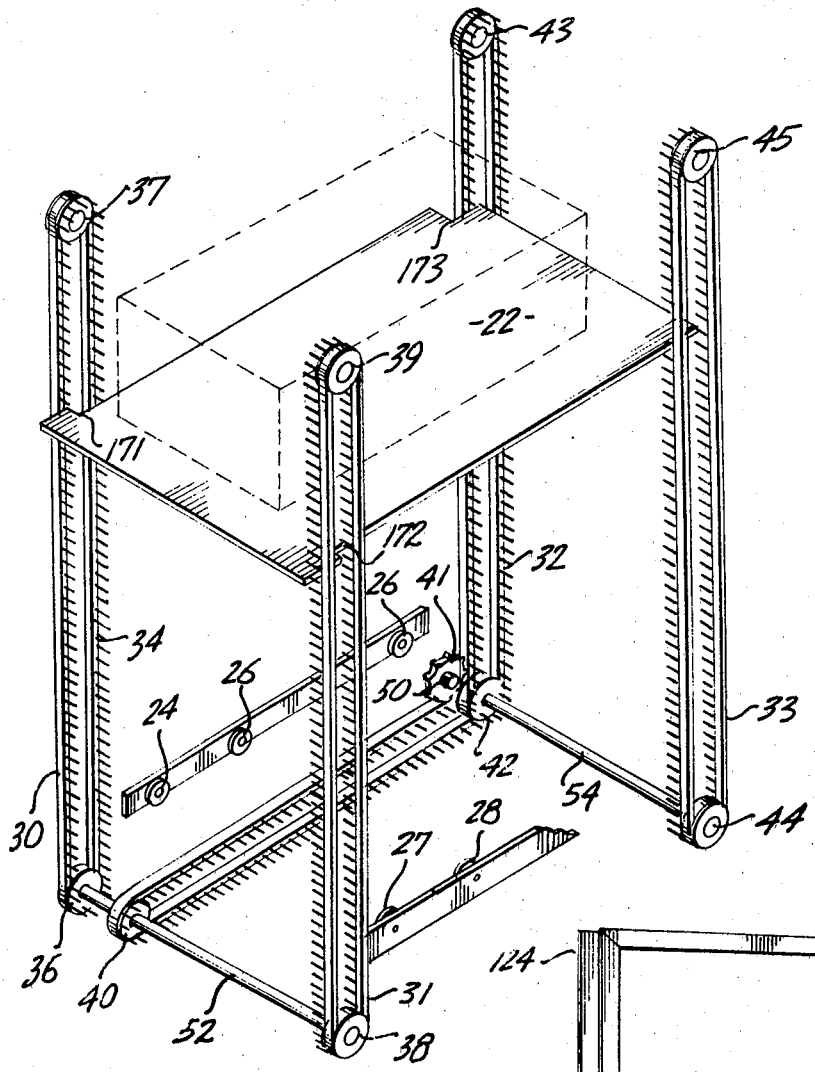
FIG. 2 is an isometric representation of the elevator chain drive system.

Referring now to FIG. 2 we see a schematic representation of the elevator chain drive system. First elevator chain 30 is positioned upon elevator chain sprockets 36 and 37. Elevator chain sprocket 36 is nonrotatably connected to first drive shaft 52 which is at the front of the paper feeder. Also nonrotatably connected to first drive shaft 52 are elevator chain sprockets 38 and 40. Elevator chain sprockets 38 and 39 together support second elevator chain 31. Elevator chain sprockets 40, 42 and 43 together with elevator chain drive sprocket 41 support third elevator chain 32. Elevator chain sprocket 42 is nonrotatably connected to second drive shaft 54 which is located towards the rear of the paper feeder. Also nonrotatably connected to second drive shaft 54 is elevator chain sprocket 44. Elevator chain sprockets 44 and 45 support fourth elevator chain 33.

Figure 3:
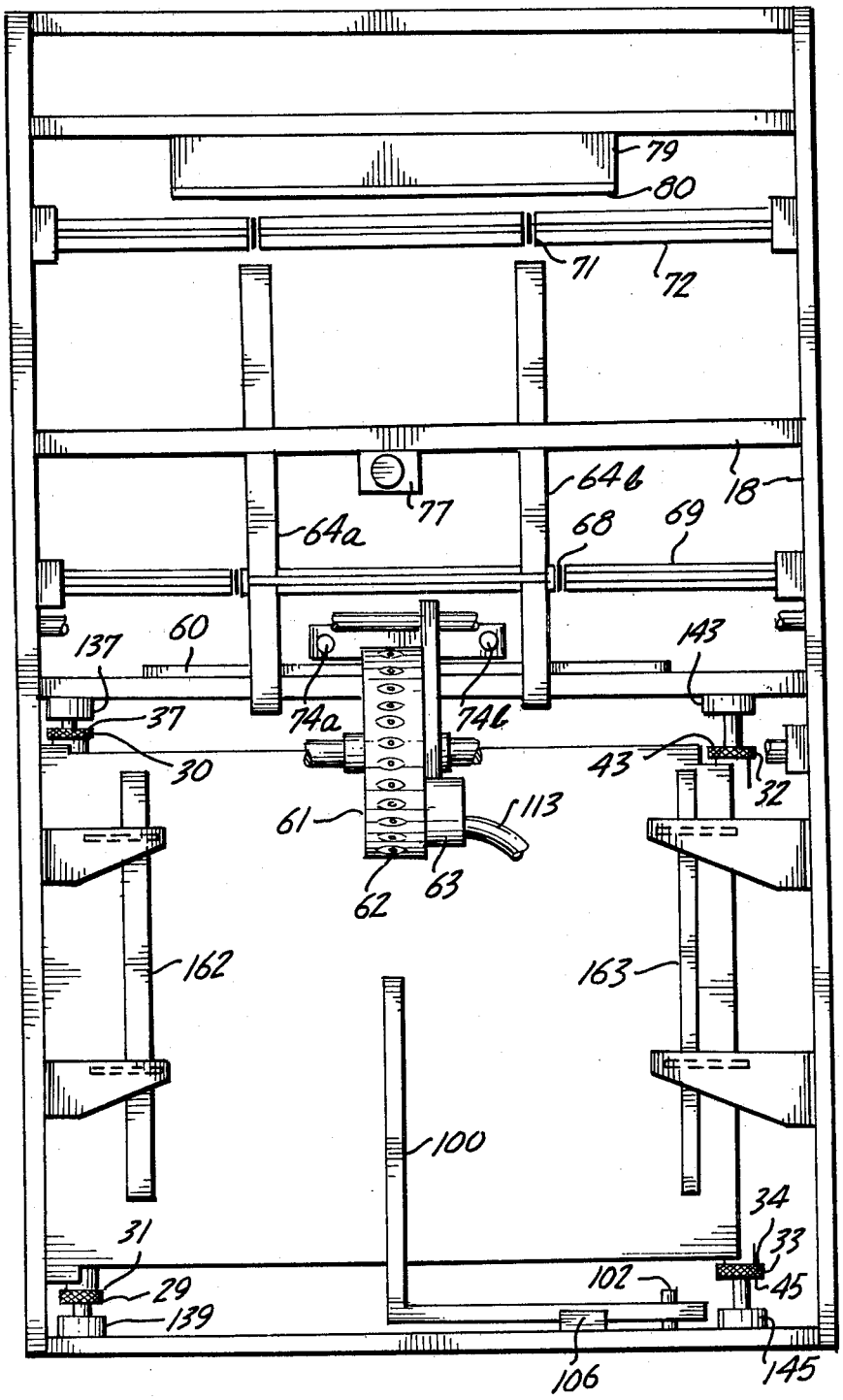
FIG. 3 is a plan view of the paper feeder of FIG. 1 with parts removed for clarity of presentation.

The portion of the elevator drive system described above is rotatably connected to the paper feeder frame 18 by a number of bearings. As shown in FIG. 3, chain sprockets 37, 39, 43 and 45 are rotatably supported by bearings 137, 139, 143 and 145 respectively. Other bearings are not shown or numbered for clarity of presentation.

The elevator chain drive sprocket 41 is nonrotatably connected to elevator speed reducer motor output shaft 50. As shown in FIG. 1, elevator motor speed reducer output shaft 50 is connected to elevator motor speed reducer 49, elevator motor means 48 and elevator brake 47 in series. When elevator motor 48 causes elevator motor speed reducer 49 to turn output shaft 50 in a counterclockwise direction as seen in FIG. 2, the frontward vertical runs of first, second, third and fourth elevator chains 30, 31, 32 and 33, respectively, all travel in an upward motion at the same velocity. The elevator brake 47 is used to prevent movement of the elevator chain drive system whenever brake 47 is engaged, specifically when the elevator motor 48 is neither lowering or raising tray 22.

The top sheet in stack 20 must be maintained at a nearly constant elevation with respect to the paper feed train. To do this, stack height detector 100 (FIG. 1) is pivotally mounted to paper feed frame 18 by stack height detector pivot 102 so that the stack height detector 100 is above stack 20. When stack 20 is raised high enough that the top sheet engages stack height detector 100 the stack height control switch 104 is opened and the elevator motor means 48 is stopped. Concurrently therewith, the elevator brake 47 is engaged to prevent further movement of the elevator chain drive system. As sheets of paper are drawn off the top of stack 20, the elevation of the remaining top sheet is progressively lowered. This causes stack height detector 100 to pivot into a lower position which closes stack height control switch 104 causing elevator motor 48 to raise tray 22. Also, provided is stack height limit switch 106 which prevents the stack from being raised too high due to a failure in stack height control switch 104.

As shown in FIG. 1, first elevator chain 30 and second elevator chain 31 are positioned further apart than third elevator chain 32 and fourth elevator chain 33. Both of the rear elevator chains, third elevator chain 32 and fourth elevator chain 33, are set inward from their corresponding front chains, first elevator chain 30 and second elevator chain 31, respectively. This spacing is suggested by the need to have only one of the runs of the drive chains engage the bottom of tray 22 with chain pins 34. Accordingly tray 22 is provided with notches 171, 172 and 173 resulting in its front edge being wider than its rear edge which also allows for easy insertion of tray 22 within the elevator. The rear edge of tray 22 extends only so far as to allow tray 22 to be engaged by the forward runs of third and fourth elevator chains 32 and 33.

The upper portion of paper stack 20 is aligned by stack guides 162 and 163 (FIG. 3). Stack guides 162 and 163 are adjustable for varying widths of sheets by moving stack guides 162 and 163 with respect to paper feeder frame 18.

Adjacent to the top sheet in stack 20 there is a pneumatic separator 60 which causes a jet of air to impinge upon the leading edge of the top few sheets. The action of this impinging jet of air raises the leading edge of the top sheet, bringing it sufficiently close to high-vacuum wheel 61 so that it is sucked against the periphery of the high-vacuum wheel 61. The high-vacuum wheel 61 is mounted on a rotatable shaft 106 rotatably supported by paper feeder frame 18. The high-vacuum wheel has a series of peripheral openings 62 which open to an interior vacuum plenum which can be concentrated over a portion of the circumference of the high-vacuum wheel as required by the user. The high-vacuum wheel and rotatably shaft 106 are rotated by a high-vacuum wheel motor (not shown) through a reduction drive system (not shown) located at the rear of the paper feeder.

The vacuum necessary to operate high-vacuum wheel 61 is supplied by vacuum pump 108 driven by vacuum pump motor 109. The exhaust of the vacuum pump 112 is used to supply the sheet separator 60 with a supply of compressed air. The vacuum supplied through hose 113 to the high-vacuum wheel 61 is controlled through a vacuum control valve 63 by shunting the vacuum to atmosphere when operation of the high-vacuum wheel 61 is not needed.

High-vacuum wheel 61 rotates in a clockwise manner as viewed in FIG. 1, driving the sheet of paper against top guide plates 64*a* and 64*b* which strip it from the high-vacuum sheel 61 as the sheet moves along the paper path. The sheet of paper passes between the top guide plates and the bottom guide plates 66*a, b* and 67*a, b*.

Positioned across the paper path between the high-vacuum wheel 61 and the first roller means 68 and 69 is the marker sheet detection means comprising beam sources 74*a* and 74*b* and beam detectors 76*a* and 76*b*. Light beams shining from beam sources 74*a* and 74*b* towards beam detectors 76*a* and 76*b* are intermittently obstructed by the passage of a sheet of paper. When specially prepared marker sheets having only one hole pass through the marker sheet detection means one of the signal beams strikes its corresponding detector through the hole while the remaining beam is shaded from stricking its corresponding detector. This unbalanced signal indicates to the control means that a marker sheet is passing through the paper feeder and appropriate control changes are made as discussed below.

The leading edge of a sheet of paper is engaged by a first roller means comprising an upper first pinch roller 68 and a lower first pinch roller 69. The upper first pinch roller is provided with resilient tires about its circumference to provide better friction between the first roller means and the sheet of paper being driven therethrough. First roller means 68 and 69 are rotated by a roller means motor (not shown) through a flexible belt (not shown), both located at the rear of the paper feeder.

Double sheet detector means 77 is located adjacent to the paper path and provides a means for detecting when two or more sheets of paper are being fed simultaneously. This information is used to actuate rejection diverter actuator 85 which causes rejection diverter 86 to divert the double sheets into rejection tray 88. The double sheet detector means 77 also provides information to the control means so that multiple sheets are not added to the total number of sheets fed as compiled by the control means.

Before a sheet of paper is driven completely through first roller means 68 and 69 it is engaged by second roller means 71 and 72 thereby providing continous motion. Upper second pinch roller 71 is provided with resilient tires about its circumference so that better friction is developed with the sheets of paper. Second roller means 71 and 72 are rotated by the roller means motor (not shown) through a flexible belt (not shown) both located at the rear of the paper feeder.

Adjacent to the output side of second roller means 71 and 72 is a first deflector 79 which redirects a sheet of paper in a downward direction. Deflector guide plate 80 lies adjacent to first deflector 79 helping to guide the sheet of paper during this redirection.

Adjacent to the paper path is a counting means comprising a counter beam 82 and a counter beam detector 83. The intermittent shading of the counter beam detector caused by the passage a sheet of paper indicates to the control means the number of sheets passing the counting means. This information is used by the control means in controlling the paper feeder and other paper handling equipment.

The rejection diverter 86 is rotated on pivot 87 by rejection diverter actuator 85 into the paper path as shown by displaced rejection diverter 86*a*. The displaced rejection diverter 86*a* causes a sheet of paper to be diverted into the rejection tray 88. If rejection diverter 86 is not rotated into the paper path then the sheet of paper continues downwardly until it is drawn against the porose first vacuum transport conveyor belt 90 by the suction within the first conveyor plenum 91. This suction is created by fan 201. The first vacuum transport conveyor belt 90 is supported by conveyor belt rollers 92 and 93. Conveyor belt roller 92 is rotated by the roller means motor that also drives first roller means 68 and 69 and second roller means 71 and 72.

The inertia of a paper sheet causes it to be removed from the first vacuum transport conveyor belt 90 near second deflector 96. Second deflector 96 redirects downwardly moving sheet of paper in a more horizontal direction and onto second vacuum transport conveyor belt 95. Second vacuum transport conveyor belt 95 is supported by second conveyor belt rollers 97 and 98 and has a second conveyor plenum 99. A suction is developed in plenum 99 by fan 202. A sheet of paper is inertially removed from second vacuum transport conveyor belt 95 and it continues onto another piece of paper handling equipment.

Figure 4:
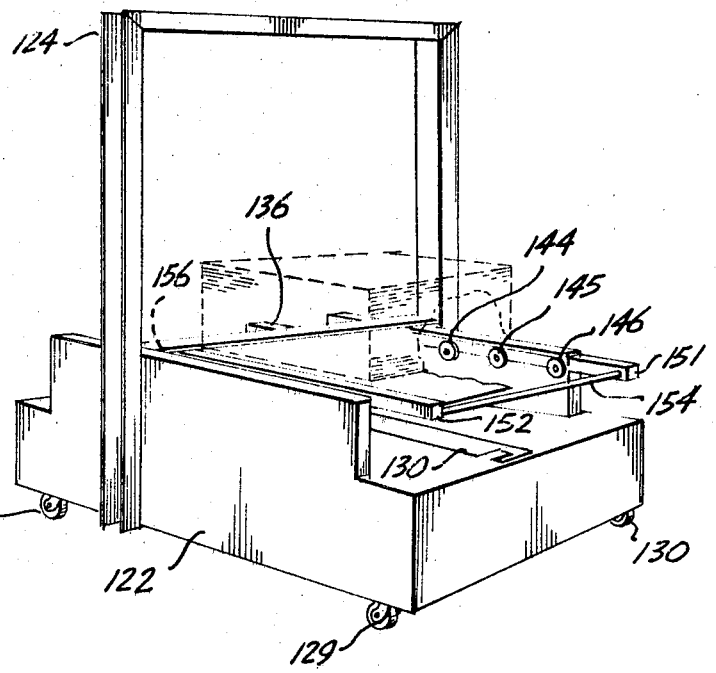
FIG. 4 is a perspective view of the cart.

Referring now to FIG. 4 we see that cart 120 which has a cart frame 122. Cart frame 122 is supported by cart casters 128, 129, 130 and 131 (not shown) and is easily movable on said cart casters. Attached to the cart frame 122 is a cart superstructure 124 used for easily handling the cart 120 without bending or stooping as would be necessary to grasp the cart frame 122.

Attached to cart frame 122 is the tray carriage made up of a first tray carriage side rail 151, a second tray carriage side rail 152, a front tray carriage rail 154 and a rear tray carriage rail 156. First and second tray carriage side rails 151 and 152 are firmly attached to cart frame 122. Rotatably attached to first tray carriage side rail 151 are three rotatable cart tray rollers 144, 145 and 146. Similarly attached to second tray carriage side rail 152 are cart tray rollers 141, 142 and 143 (not shown). The tray 22 is supported on the top of cart tray rollers 141–146 and is easily rollable upon them. The locking means 136 is attached to rear tray carriage rail 156 and provides a means for securely attaching the tray 22 to the cart 120.

Attachment means 134 is an elongated strap-shaped piece pivotally connected to cart frame 122 having a hook in the front end to engage paper feeder frame 18 while tray 22 is rolled into the elevator from cart 120.

The control means controls the operation of the paper feeder and coordinates the operation of the paper feeder with other paper handling equipment. The control means is provided with a programmable feature which enables the operator to designate the desired number of sheets which will be fed to the other paper handling device for different types of paper. For each new type of paper, which is set off by a marker sheet, the control means is preprogrammed to deliver a desired number of copies to the other paperhandling equipment. During operation the number of sheets of any particular type are counted by the counting means 82 and 83 with correction for multiple sheets occurring in the control means. When the preprogrammed number of sheets have passed to the other paper handling equipment no further sheets of the first type are fed. All remaining sheets of the first type are diverted by the rejection diverter 86 to the rejection tray 88. The passage of a marker sheet through the marker sheet detection means 74*a, b* and 76*a, b* causes the control means to discontinue rejecting sheets with the rejection diverter 86. The control means continues with the preprogrammed number of sheets for the second type of sheet. When the preprogrammed number of sheets of the second type have been delivered, no further sheets of that type are fed to the other paper handling equipment. Again, if any excess sheets of the second set remain they are diverted by the rejection diverter 86 into the rejection tray 88 until another marker sheet causes the control means to repeat the process. In this manner a large number of sheets of paper of numerous types can be automatically fed to other paper handling equipment without the need of an operator to make correction for double sheets or excess sheets in the stack.

The application of the current invention paper feeder for use with a sorter will further explain the advantages of automatically operating the paper feeder and sorter with the control means. The operator preprograms the number of sheets which are to be fed to the sorter for each type of sheet. Each sheet in the first set is placed in a separate sorter bin. Excess sheets which were contained in the paper stack 20 are not fed to the sorter but instead go into rejection tray 88. The presence of a marker sheet in the stack causes the control means to once again start feeding sheets to the sorter from the second set. The control means directs the sorter to place these sheets in the desired bins. In this manner the sorter can arrange a large number of documents, each containing one or more, if so desired, copies from each of the sets of sheets which were contained in the paper stack 20.

INDUSTRIAL APPLICABILITY

This paper feeder is ideal for use with automated sorters or collators. The paper feeder could also be used to feed sheets of paper one at a time to other paper handling or printing process equipment such as where multiple printing operations are required, where documents need to be photographed and stacked, or other such applications.

It will be apparent to those skilled in the pertinent arts that various modifications can be made to this paper feeder consistent with the inventive concepts taught by this disclosure and drawings.

What is claimed is:

1. A paper feeder for feeding single sheets of paper from a stack of paper located on a tray, to other paper handling equipment, comprising:

a tray for holding a stack of paper sheets;

a paper feeder frame;

a paper stack elevator means for supporting and vertically positioning said tray and said stack so that the top sheet of said stack is at a proper feed elevation; said stack elevator means being capable of receiving trays or paper sheets from the side thereof;

said stack elevator means including a first pair of moveable and opposed tray supporting means for engaging, supporting and vertically positioning said tray; said first pair of tray supporting means being separated a distance equal of a first gage;

said stack elevator means also including a second pair of movable and opposed tray supporting means for engaging, supporting and vertically positioning said tray; said second pair of tray supporting means being separated a distance equal to a second gage smaller than said first gage; whereby said tray can be easily inserted into said elevator means from the side and said tray will engage only one run of each of said tray supporting means; and a paper feed train means for taking paper sheets from the top of said stack, conveying them along a paper path, and delivering them to other paper handling equipment.

2. The paper feeder of claim 1 wherein said paper stack elevator means is further defined by:

a set of elevator tray roller means for rolling said tray from a cart into said elevator means;

said first pair of tray supporting means having:

a first set of sprocket wheels;

a first chain arranged about said first set of sprocket wheels;

a second set of sprocket wheels;

a second chain arranged about said second set of sprocket wheels;

said second pair of tray supporting means having:

a third set of sprocket wheels;

a third chain arranged about said third set of sprocket wheels;

a fourth set of sprocket wheels;

a fourth chain arranged about said fourth set of sprocket wheels;

said paper stack elevator means being further defined by:

said first set of sprocket wheels having at least one sprocket wheel sharing a common shaft with and nonrotatably fixed to at least one sprocket wheel of said second set of sprocket wheels, whereby a lineal movement of said first chain causes an equal lineal movement of said second chain;

said third set of sprocket wheels having at least one sprocket wheel sharing a common shaft with and nonrotatably fixed to at least one sprocket wheel of said first set of sprocket wheels, whereby a lineal movement of said first chain causes an equal lineal movement of said third chain;

said fourth set of sprocket wheels having at least one sprocket wheel sharing a common shaft with and nonrotatably fixed to at least one sprocket wheel of said third set of sprocket wheels, whereby a lineal movement of said fourth chain causes an equal lineal movement of said third chain;

an elevator motor means driving at least one sprocket of any of said sets of sprockets, whereby said first chain, said second chain, said third chain, and said fourth chain are all driven equal linear distances in either of two directions;

elevator chain pins attached to each of said first chain, said second chain, said third chain, and said fourth chain for engaging the lower side of said tray and supporting said tray as said tray is moved vertically upward or downward when driven by said elevator motor means.

3. The paper feeder of claim 2 wherein said paper stack elevator means further comprises:

stack height detection means for sensing the elevation of the top sheet of said paper stack relative to said paper feeder frame; and switching means for transforming a sensed deficiency in elevation of said top sheet of paper into a command to said elevator motor means to drive said stack upward.

4. The paper feeder of claims 1 or 2 also including:

a rollable cart for supporting a stack of sheet paper upon a tray and for delivering said stack and said tray to said elevator means, comprising:

a cart frame;

rollable casters supporting said cart frame above a floor;

a set of cart tray roller means rotatably mounted on said cart frame whereby a tray is movably supported thereon; said cart tray roller means being at substantially the same elevation as said elevator tray roller means thereby allowing said tray to be rolled from said cart into said elevator means;

a locking means for securing said tray to said cart; and an attachment means for nonmovably positioning said cart relative to said paper feeder frame.

5. The paper elevator means of claim 4 further defined by:

said first pair of tray supporting means having:

a first set of sprocket wheels;

a first chain arranged about said first set of sprocket wheels;

a second set of sprocket wheels; and, a second chain arranged about said second set of sprocket wheels;

said second pair of tray supporting means having:

a third set of sprocket wheels;

a third chain arranged about said third set of sprocket wheels;

a fourth set of sprocket wheels; and a fourth chain arranged about said fourth set of sprocket wheels;

said first set of sprocket wheels having at least one sprocket wheel sharing a common shaft with and nonrotatably fixed to at least one sprocket wheel of said second set of sprocket wheels, whereby a lineal movement of said first chain causes an equal lineal movement of said second chain;

said third set of sprocket wheels having at least one sprocket wheel sharing a common shaft with and nonrotatably fixed to at least one sprocket wheel of said first set of sprocket wheels, whereby a lineal movement of said first chain causes an equal lineal movement of said third chain;

said fourth set of sprocket wheels having at least one sprocket wheel sharing a common shaft with and nonrotatably fixed to at least one sprocket wheel of said third set of sprocket wheels, whereby a lineal movement of said fourth chain causes an equal lineal movement of said third chain;

an elevator motor means driving at least one sprocket of any of said sets of sprockets, whereby said first chain, said second chain, said third chain, and said fourth chain are all driven equal linear distances in either of two directions;

elevator chain pins attached to each of said first, second, third and fourth elevator chains for engaging the lower side of said tray and supporting said tray as said tray is moved vertically upward or downward when driven by said elevator motor means;

a set of elevator tray roller means for rolling said tray from a cart into said elevator means;

a stack height detection means for sensing the elevation of the top sheet of said paper stack relative to said elevator frame; and switching means for transforming a sensed deficiency in elevation of said top sheet of paper into a command to said elevator motor means to drive said stack upward.

6. In paper handling equipment wherein sheets of paper from a stack are supplied at a substantially constant elevation relative to at least part of said paper handling equipment, the improved elevator means comprising:

a tray for holding a stack of paper sheets;

a paper elevator frame;

a paper stack elevator means for supporting and vertically positioning said tray and said stack so that the top sheet of said stack is at a proper feed elevation; said stack elevator means being capable of receiving trays or paper sheets from the side thereof;

said stack elevator means including a first pair of movable and opposed tray supporting means for engaging, supporting and vertically positioning said tray; said first pair of tray supporting means being separated a distance equal to a first gage;

said stack elevator means also including a second pair of movable and opposed tray supporting means for engaging, supporting and vertically positioning said tray; said second pair of tray supporting means being separated a distance equal to a second gage smaller than said first gage; whereby said tray can be easily inserted into said elevator means from the side and said tray will engage only one run of each of said tray supporting means.

7. The paper elevator means of claim 6 used in conjunction with a rollable cart for supporting a stack of sheet paper upon a tray and for delivering said stack and said tray to said elevator means, comprising:

a cart frame;

rollable casters supporting said cart frame above a floor;

a set of cart tray roller means rotatably mounted on said cart whereby a tray is movably supported thereon;

said cart tray roller means being at substantially the same elevation as said elevator tray roller means thereby allowing said tray to be rolled from said cart into said elevator means;

a locking means for securing said tray to said cart; and, an attachment means for nonmovably positioning said cart relative to said elevator frame.

* * * * *